US005845456A

United States Patent [19]

Read

[11] Patent Number: 5,845,456

[45] Date of Patent: Dec. 8, 1998

[54] BASEMENT WATERPROOFING

[76] Inventor: Robert R. Read, 3246 Jenny Lind Rd., Amelia, Ohio 45102

[21] Appl. No.: 628,187

[22] Filed: Dec. 14, 1990

Related U.S. Application Data

[63] Continuation of Ser. No. 318,856, Mar. 6, 1989.

[51] Int. Cl.[6] ..... E04G 23/02; E02D 37/00

[52] U.S. Cl. ..... 52/741.11; 52/169.5; 52/514; 52/741.4

[58] Field of Search ..... 52/169.5, 169.14, 52/514, 742, 741.11, 741.3, 741.4

[56] References Cited

U.S. PATENT DOCUMENTS

| | | | |
|---|---|---|---|
| 1,734,777 | 11/1929 | Pike | 52/169.5 |
| 2,461,610 | 2/1949 | Lord | 52/12 |
| 3,852,925 | 12/1974 | Gazzo | 52/169.5 |
| 4,075,800 | 2/1978 | Molick | 52/169.5 |
| 4,333,281 | 6/1982 | Scarfone | 52/169.5 |
| 4,538,386 | 9/1985 | DiCello | 52/169.5 |
| 4,553,356 | 11/1985 | Pepper | 52/12 |
| 4,590,722 | 5/1986 | Belevacqua | 52/169.5 |
| 4,612,742 | 9/1986 | Bevelacqua | 52/169.5 |
| 4,745,716 | 5/1988 | Kuypers | 52/169.5 |

*Primary Examiner*—Michael Safavi
*Attorney, Agent, or Firm*—Kinney & Schenk

[57] ABSTRACT

A drain conduit is disposed contiguous with and sealed to a footer which supports a foundation wall. The conduit is an upwardly open, impervious trough having an openwork cover. Any water leaking through the foundation wall or between the wall and the footer is captured by the drain conduit so that it does not enter the subsoil and weaken the support for the footer. Where the foundation wall has a crack opening onto its inner surface, it is enlarged and then covered by a moisture barrier film strip and a fiberglass panel, both of which are secured to the wall. Leakage water, through the crack, is thus channelized and directed towards the juncture between the inner surface of the wall and the upper surface of the footer for flow into the drain conduit. The panel terminates above the footer and film strip is extended across the footer and overlies the drain conduit. Where the foundation wall is formed of concrete blocks, holes are formed in the lower course of the blocks to drain their interiors onto the footer. Where there is a leakage flow path underneath the footer, the drain conduit is disposed beneath its lower surface.

9 Claims, 3 Drawing Sheets

BASEMENT WATERPROOFING

This application is a continuation of application Ser. No. 318,856 filed Mar. 6, 1989.

The present invention relates to improvements in waterproofing basements including an improved basement construction, its method of construction and an improved drain therefor.

Water leakage into basements poses many serious problems. It can make the basement unusable and ruin furnaces, appliances, furnishings stored items, and the like. It can also cause excessive humidity which will cause deterioration of a building's structure and permeate its upper levels. The process of curing leakage of water is commonly referenced as waterproofing.

Water can enter a basement in several ways. Conventional basements comprise three elements, namely, a foundation wall, a footer on which the wall rests and a floor slab. When originally constructed, the joints between these elements are sealed with tar, or some other joint compound. Over time the joint compound dries and becomes brittle. Contraction and expansion of the floor, wall and footer causes the joint compound to crack, thus creating gaps for water to seep beneath the floor and ultimately through the joint between the floor and wall, into the basement. Such contraction and expansion, as well as uneven settling of the footer and foundation, can also cause cracks in the foundation wall which also provides leakage paths for water to seep into the basement.

The source of water entering the basement can be either surface water or groundwater, as where the water table raises above the level of the basement floor. Under some, not uncommon, conditions, water pressure on the exterior of the foundation can exert sufficient pressure to crack a foundation wall and thus provide further leakage flow paths.

An obvious, but impractical, solution is to fabricate basement walls and floors, as well as the joints therebetween, which are leakproof. While such a construction is feasible, in most instances, it requires techniques and thicknesses which make it too expensive to be employed for most residences or other buildings where water leakage is a problem.

The common approach to solving a leakage problem is to direct the leakage water to a sump from which it may then be drained, or pumped, to a lower level, either interiorly or exteriorly of the foundation. Also it is a fairly common practice to surround the foundation with underground drain tiles which direct ground water to a remote location. The problem with such drain tiles is that they become clogged and lose their effectiveness.

It has also been recognized that concrete block, foundation walls tend to develop cracks which permits soil water to collect in the internal chambers of the blocks. Eventually the depth of water in these chambers reaches a level such that a crack develops, if it has not otherwise been formed, which permits seepage of water into the interior of the basement.

Several proposals have been made for providing drainage holes in the lower course of blocks so that water will be drained from the wall. A drain pipe is then provided in a bed of gravel, or the like, adjacent the inner surface of the foundation's footer. These drain pipes are circumferentially pervious to water and carry away water from the gravel bed, and wall, to appropriate disposal means. Representative proposals of this type are found in U. S. Pat. Nos. 3,287,866, 3,562,982, 4,486,986, 4,538,386, 4,590,722 and 4,612,742.

The shortcoming of these and other similar proposals is that the leakage water is free to, and for the most part will flow through the gravel bed into the underlying subsoil on which the footer rests. Only if the soil water level, or water table, rises to the level of the drain pipe will a substantial amount of water be carried away for appropriate disposal.

Assuming that there is no leakage of water beneath the footer, i.e., the underground water table is below the footer, then water which has leaked through the foundation wall, passes through the gravel bed and saturates the subsoil on which the footer is supported. Such saturation then permits or accelerates settling of the footer and additional cracks in the foundation wall.

Another approach to waterproofing exemplified in U.S. Pat. Nos. 3,852,925 and 4,333,281, is to provide paneling in spaced relation to the interior surface of a foundation wall. Water penetrating onto this interior surface flows into drain means peripherally of the basement floor and then into drain conduit means. beneath the floor. This approach only masks the problem inasmuch as moisture and dampness are always present in the basement.

Basement water problems usually become apparent some time after completion of a building, as when an exterior tile drain becomes clogged. Installing a new exterior drainage system becomes unduly expensive because of the large amount of excavation required and the damage done to foundation plantings and other accouterments. Therefore it is desirable that waterproofing be accomplished from the interior of the building, Accordingly, the broad object of the present invention is provide for improved waterproofing of basements.

A more specific object of the invention is control leakage water so that the interior surfaces of the basement, and particularly the foundation wall, are dry and humidity is minimized.

Another object of the invention is to maintain the stability of the footer of the foundation in waterproofing a basement.

A further object of the invention is to economically enable waterproofing of a basement after completion of a building.

The foregoing ends may be attained in a basement construction comprising a foundation wall having portions defining the basement area, a footer underlying and supporting the wall and a floor spanning the wall portions.

In accordance with one aspect of the invention a drain conduit extends lengthwise of and is juxtaposed relative to the footer in the area where leakage exists. The drain conduit comprises an impervious trough and an openwork cover. The drain conduit is disposed with the upper surface of the trough below the upper surface of the footer and with its edge contiguous with the inner surface of the footer. Preferably the contiguous edge of the drain conduit is sealed to the inner surface of the footer. The top surface of the footer and the drain conduit are overlaid with a layer of gravel. The drain conduit may also be more positively positioned by an underlying concrete bed.

With this arrangement, all water that seeps beneath the foundation wall and the footer, or otherwise collects on the footer, flows into the drain conduit, and then may be conveyed to means which dispose of the water so that it does not pose an unwanted water problem in the basement.

Where there is leakage through a crack in the foundation wall, means are provided for directing the leakage water to the juncture between the inner surface of the foundation wall and the upper surface of the footer so that it can flow to the drain conduit.

In a concrete block foundation, where leakage water collects in the internal chambers of the blocks, openings may be formed in the inner walls of the lower course of blocks to permit the water to drain onto the footer and into the drain conduit.

Where a leakage path is through a crack in a poured concrete foundation wall, the leakage water is channelized to a point below the surface of the floor and above the upper surface of the footer. Strip means secured to the inner surface of the wall are employed to accomplish this end. The strip means may comprise a thin vapor barrier film overlying the opening of the crack onto the inner surface of the wall and secured thereto on opposite sides of the crack. Further, a panel, may also be secured to the wall in overlying relation to the vapor barrier film. Preferably the panel extends beneath the floor and terminates in spaced relation above the footer. The vapor barrier film may then extend over the footer and terminate above the drain conduit.

In accordance with the method aspects of the invention, where an existing basement is waterproofed in pursuant to the present teachings a portion of the basement floor is removed marginally of the wall. The underlying gravel and/or subsoil is then excavated to expose the footer. This permits installation of the drain conduit in the fashion above describe. Likewise, as appropriate, holes can be formed in the lower course of concrete blocks or a crack in a poured concrete wall can be channelized.

After installation of the drain conduit, etc., the excavation can be filled with gravel and concrete poured thereover to form a patch for the removed portion of the floor.

The above and other related objects and features of the invention will be apparent from a reading of the following description of the invention, with reference to the accompanying drawings and the novelty thereof pointed out in the appended claims.

IN THE DRAWINGS

Figure 1:
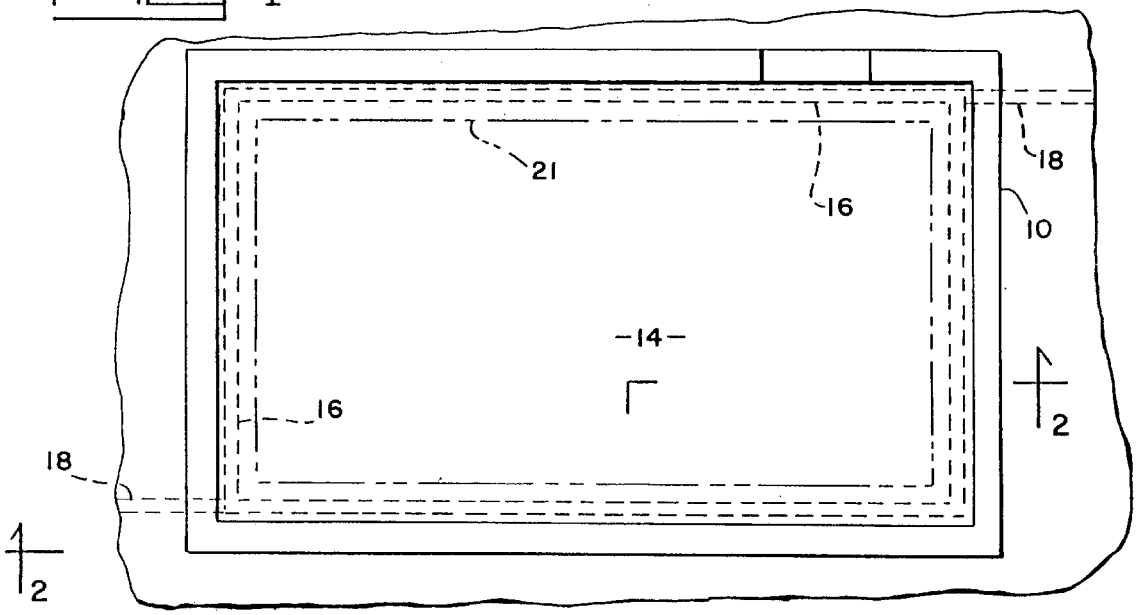
FIG. 1 is a plan view of a building foundation incorporating the present waterproofing system.
Figure 2:
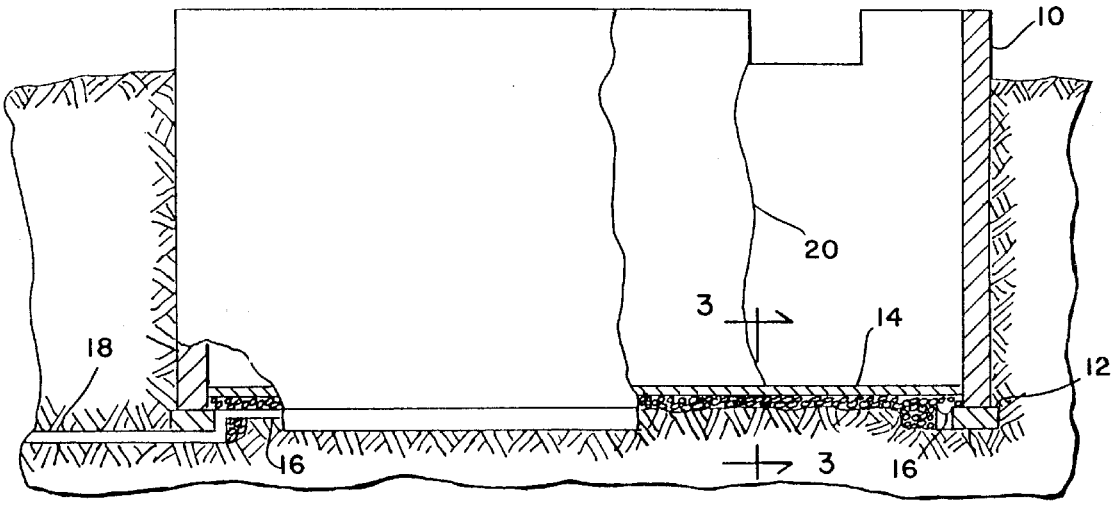
FIG. 2 is a section taken generally on line 2—2 in FIG. 1 and with portions broken away.

FIGS. 1 and 2 illustrate a typical foundation for a residence. It comprises a wall 10 having portions which define a rectangular basement area. It rests on and is supported by a footer 12, which also has rectangularly disposed portions. The foundation is completed by a floor 14, below ground level, which spans the foundation wall. The wall 10, footer 12 and floor 14 may be formed by poured concrete.The joints between the footer and the wall and between the wall and the floor may be sealed by tar or other joint compound (not shown).

As will be further apparent from the following description, the ends of the present invention may be attained through directing leakage water to drain conduits 16. The drain conduits are pitched, in pairs, to direct the leakage water to conduits 18 which drain the leakage water to appropriate disposal locations, which could be in the form of a sump and a pump to further facilitate disposal of the water. While the described disposal of leakage water to a point remote of the foundation is preferred, within the broader aspects of the invention the leakage water could be drained to a sump interiorly of the basement.

In FIG. 2 a typical leakage flow path is indicated by a crack 20 in the foundation wall 10 (the means which treat this crack pursuant to the present invention, are not shown in this Figure). Any other wall cracks would also be treated in the manner to be described in order to eliminate moisture in the basement.

Figure 3:
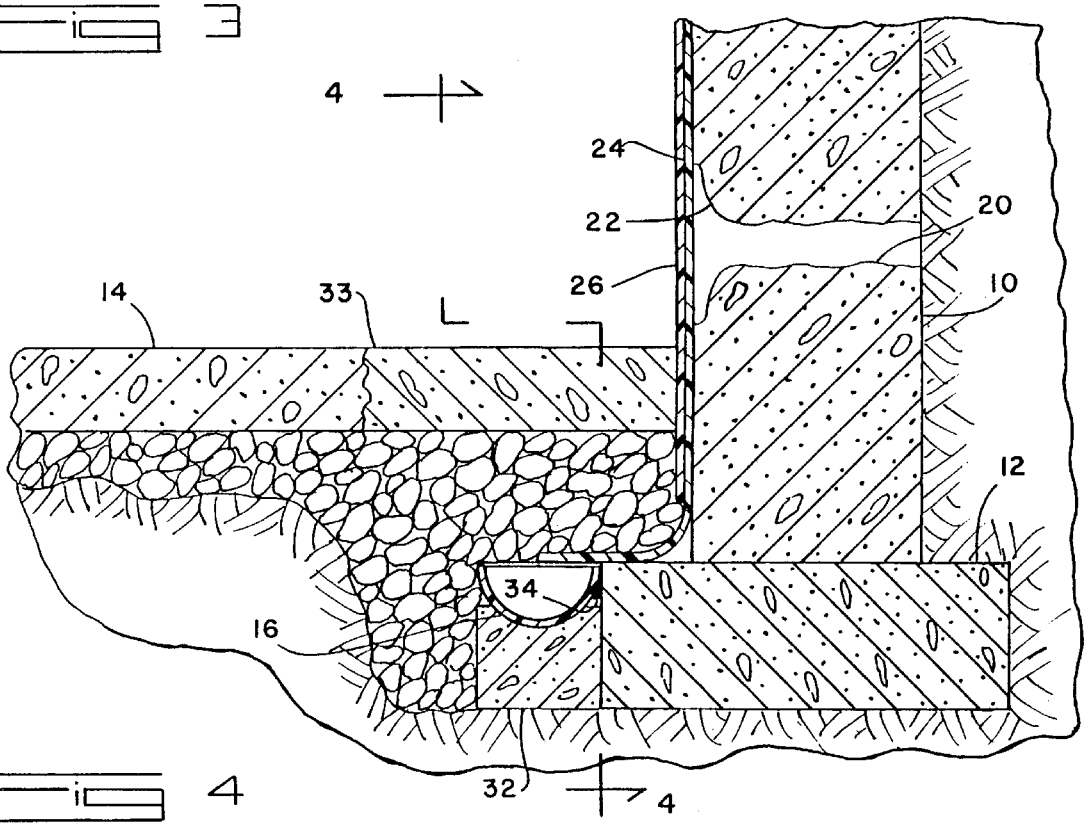
FIG. 3 is a section, on an enlarged scale, taken on line 3—3 in FIG. 2.

In accordance with one aspect of the invention, the basic approach to waterproofing a basement is to channel water from foundation wall cracks to the drain conduits 16. This is best illustrated in FIGS. 3–5.

At this point it will be noted that basement waterproofing is usually done after the fact of encountering leakage problems. A leakage flow path through a foundation wall can be readily identified. Where there is no apparent crack in either the wall or floor, the leakage flow path will be through the joint therebetween.

In any event, a portion of the floor 14 will be removed marginally along the length of the wall 10 where leakage water enters, or along the entire margin, as indicated by the phantom line 21 in FIG. 1. The width of floor removed is preferably in the order of 15 to 18 inches. When this section of the floor has been removed, underlying gravel and/or subsoil will also be removed, to expose the footer 12, in preparation for installation of the drain conduits 16. When this excavation is made, it is then possible to visually inspect the footer and ascertain whether water is leaking through the joint between the footer 12 and wall 10 and/or is leaking beneath the footer. The more common situation is that water will leak through the joint between the wall and the footer or through cracks in the wall.

Figure 4:
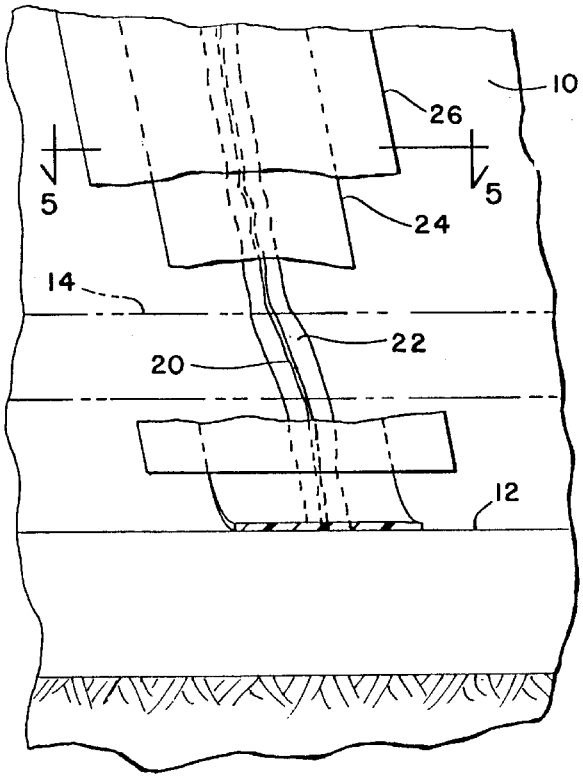
FIG. 4 is a section taken on line 4—4 in FIG. 3, illustrating a cracked foundation wall.
Figure 5:
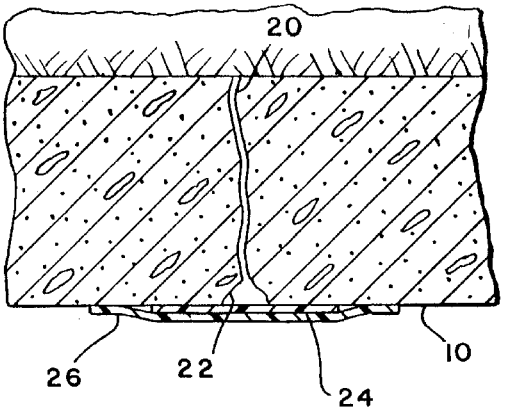
FIG. 5 is a section taken on line 5—5 in FIG. 4.

After this excavation is made, as indicated in FIG. 4, the full length of the crack 20 is, preferably, widened along the interior of the wall 10. This may be done by chipping portions of the wall away to form a V-shaped groove 22. The crack is thus enlarged from its upper end to a point below the level of the floor. (Note that in FIG. 3 the crack 20 is angled relative to the section line so that its width, and the width of the groove 22 are exagerated.) Should the crack terminate above the level of the floor, the wall will be chipped away to continue the groove below floor level.

Next the channelized crack is channelized, i.e., a closed conduit is formed for water which would leak through the crack. To this end the grooved crack and any extension thereof is covered by a suitable, plastic (resinous) vapor barrier strip 24 which may be secured to the wall surface by a tar based adhesive, or other suitable adhesive. Note that the groove should be kept free of the tar based adhesive so that water may flow downwardly without any pressure buildup which would tend to loosen the strip 24. If the crack zigzags along its length, sections of the strip 24 may be employed to minimize the width of strip required. The width of the strip is otherwise determined by being sufficient for its secure attachment to the wall surface. Several vapor barrier films are commercially available. They have thicknesses in the order of six mils, the thickness of the film strip 24 in the drawings being greatly exagerated.

A fiberglass panel (glass fibers embedded in a plastic matrix) 26, preferably having a width greater than the strip 24, is then secured to the wall 10 in overlying relation with that strip. The panel 26 has a thickness sufficient to provide protection against mechanical abuse to the strip 24. It may be secured to the wall 10 by known adhesives and/or mechanical fasteners anchored in the wall. In addition to providing mechanical protection, the panel 26 may also serve as a secondary vapor barrier.

Figure 7:
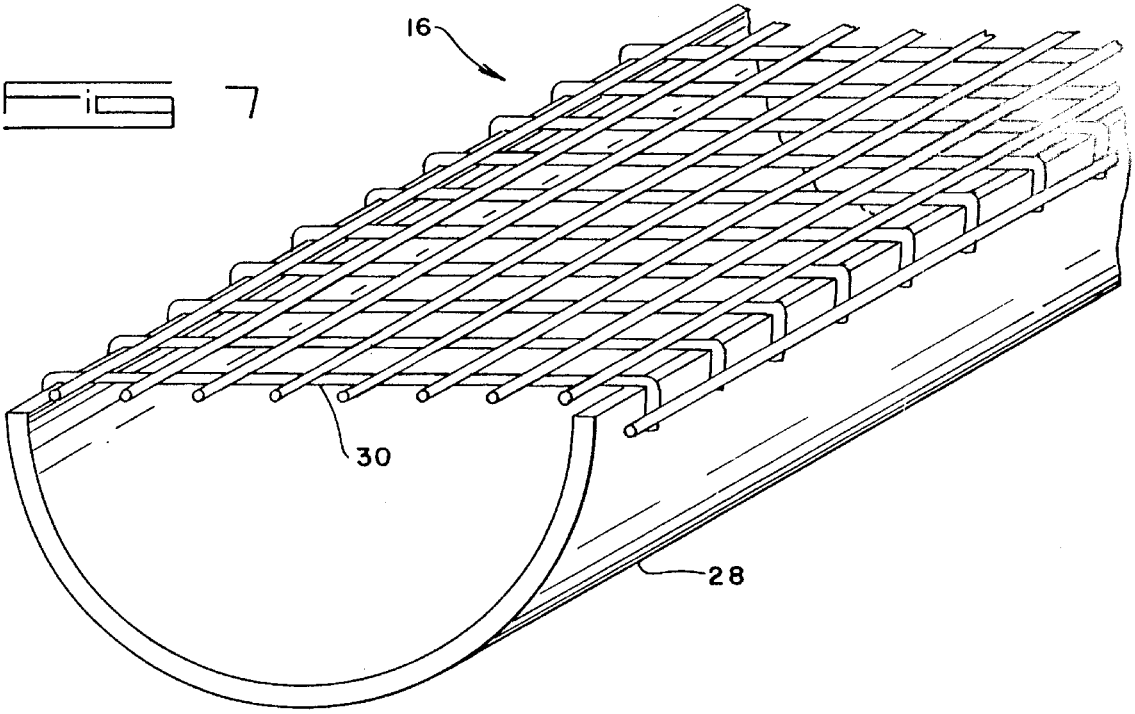
FIG. 7 is a perspective view, on a further enlarged scale, of a drain conduit employed herein.

If visual inspection reveals that there is no leakage of water from beneath the footer 12, then the top of the drain conduit 16 is disposed adjacent, but below the top of the footer, as illustrated in FIG. 3. The conduit 16 may comprises a semicircular plastic (as polypropylene) impervious, trough 28, FIG. 7

Water leakage through the foundation wall crack is thus channelized (by what is, in effect, a closed conduit on and flush with the inner surface of the wall) to flow beneath the level of the floor, without entering the interior of the basement. and an openwork cover 30. The cover may take the form of a wire screen which is bent over and formed to the outer marginal edge surfaces of the shell 28. The size of the openings in the screen 30 are small enough to prevent entry of gravel (later referenced) into the conduit 16. The screen material is also selected to provide sufficient strength so that it will not collapse under the weight of this gravel, or other forces to which it can be subjected before or after installation. The openwork cover 30 could also be formed of a suitable plastic material as a separate item or molded integrally with the trough 28.

In order to provide stability for the drain conduit 16 it may be disposed in and supported by a concrete bed 32, poured in situ along the inner side of the footer 12. Further, the outer edge of the conduit 16 is sealed to the footer 12 by tar or other suitable sealing compound.

After the drain conduit 14 is installed, the marginal excavation is filled with gravel, overlying the drain conduit to the approximate level of the lower surface of the floor 14. Finally, a cement patch 33 is poured over the gravel in the excavation so that the floor again extends to the foundation wall 10. It will be appreciated that readily drainable materials other than gravel could be employed to provide for the free flow of water into the conduit 16, and also support the floor patch.

At this point it will be noted that the panel 26 terminates below the level of the lower surface of the floor 14 and above the upper surface of the footer 12. The vapor barrier strip 24 extends beyond the strip 26, over the top of the footer 12 and then overlies the drain conduit 16 and terminates thereat. Water seeping through the crack 20 is thus channelized, by the V-shaped groove 22 and strips 24 and 26,so that it flows freely into the drain conduit 16 and then is carried outwardly of the foundation by one of the conduits 18.

The end sought to be acheived is prevent leakage water from flowing beneath the drain conduit 16 so that it can soak into the subsoil supporting the footer 12 and thus weaken the support for the foundation wall. To further assist in achieving this end, the edge of the drain conduit 16, contiguous to the footer 12, is preferably sealed to the footer by tar, as indicated at 34.

After all cracks in the foundation walls have been similarly treated, the basement will be suitably dry for all purposes. The foundation wall is not rendered impervious, but, instead, leakage continues. Leakage water, however, does not enter the basement, but is diverted to the drain conduit 16 without any pressure buildup which would cause it to leak past the strip 24 and panel 26.

The problems associated with leaks in foundation walls formed of concrete blocks are somewhat different. This illustrated in FIG. 6 where the illustrated basement may comprise a poured concrete floor 40 and a footer 42 on which a foundation wall 44 is supported.

As in the previous embodiment, a portion of the floor 40, marginally of the wall 44 is removed and the underlying portions of the subsoil excavated to expose the footer 42. (FIG. 6 illustrates the complete waterproofing system with a floor patch 45 in place and the excavation filled with gravel.)

Figure 6:
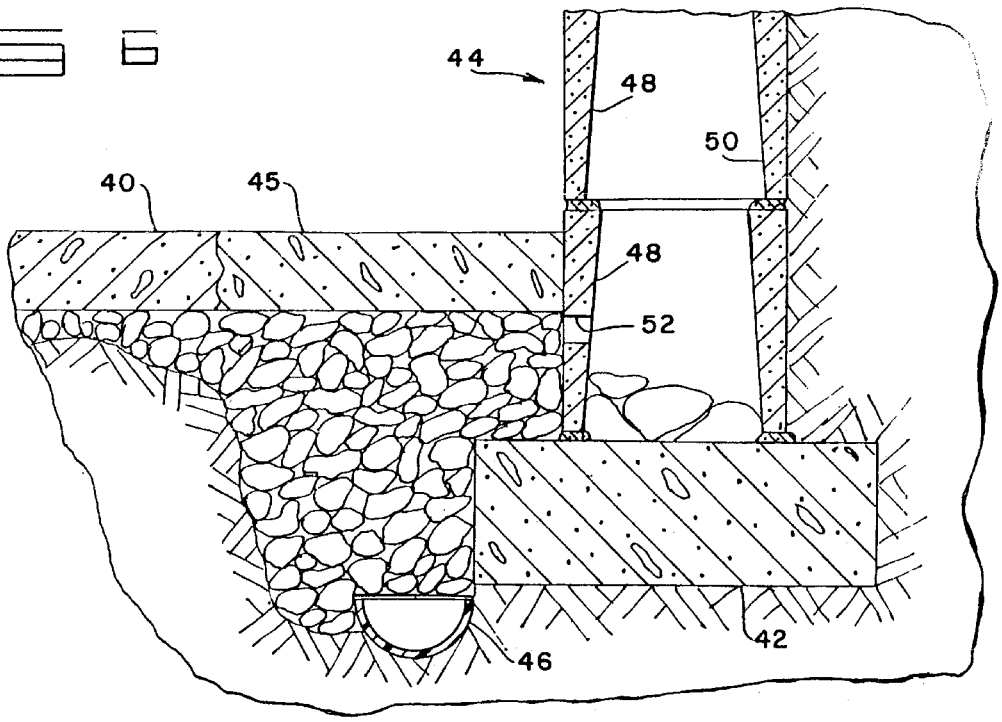
FIG. 6 is a section similar to FIG. 3, illustrating a concrete block foundation wall which has been modified in accordance with the present invention.

FIG. 6 also illustrates the disposition of a drain conduit 46 (which may be identical to the drain conduit 16) where it is discovered that there is seepage of water beneath the footing. In such circumstance, the drain conduit 46 is disposed below the level of the lower surface of the footer 42. Water, exteriorly of the foundation, may drain from beneath the footer 42 to the conduit 46 and then carried away from the foundation by a lateral conduit, corresponding to the conduit 18 in FIG. 1, but not here shown.

By providing for drainage of water from beneath the footer 42, loss of the load bearing capability of the footer is minimized and there is substantially less likelihood of the footer sinking to cause rupturing of the footer and/or the foundation wall. It will be appreciated that this expedient is effective for both poured concrete foundation walls and concrete block foundation walls.

The foundation wall is formed of concrete blocks comprising inner wall portions 48 and outer wall portions 50 interconnected by transverse ribs at their ends and a central transverse rib, such concrete block configuration being well known. The concrete blocks are bonded together by mortar and arranged in staggered relation heightwise of the wall 44.

Cracks can and do form in the blocks themselves, but more frequently form in the mortar which is used in laying them up as a wall. Also cracks can form between the mortar and the blocks. In any event, in most cases, because of their staggered disposition, water entering through such cracks usually falls into the interior of the underlying blocks. Over time the leakage water will accumulate in the interior of the lower courses of the blocks. When sufficient water pressure builds up, the water will then seep through cracks in the interior portions of the blocks, or the mortar therefor, and enter the interior of the basement. Thus, the channelizing approach, above described, is not necessarily effective in curing basement water problems in concrete block, foundation walls.

The preferred approach is to provide drainage openings 52 in the inner wall portions 48 of each concrete block in the lower course of blocks forming the foundation wall. The lateral walls of the blocks define two chambers in each block. Thus, it is preferred to form two holes in each block respectively providing for drainage of water from both of these chambers. The drainage holes are formed in the concrete blocks where leakage is apparent, though caution would dictate providing such treatment along a wall portion, or portions, much greater than where leakage is discernable.

It is usual that mortar, employed in laying up the concrete block, will drop into and set up in the chambers of the blocks. Thus it is preferred to dispose the holes 52 above the lower surfaces of the blocks forming the lower course of blocks in the wall. Any water in the interior of the blocks will drain onto the footer, but in no event can it leak into the interior of the basement.

In most cases, the level of the basement floor is above the desired location for the holes 52, as illustrated in FIG. 6. If the floor is below such level, a groove can be formed in the interior surface of the blocks, below the drainage holes. This groove can then be covered over by strip means, as above described, to assure that the water will not enter the interior of the basement. Also, if the cracks in a concrete block wall are such that water flows directly through to the interior surface of the of the wall instead of falling into the interior of the blocks, such cracks can also be channelized and covered with strips and panels in accordance with the above teachings.

These and other variations in the described embodiments will occur to those skilled in the art within the spirit and scope of the present invention as set forth in the in the following claims.

Having thus described the invention, what is claimed as novel and desired to be secured by Letters Patent of the United States is:

1. A method of waterproofing a basement comprising a foundation wall having portions defining the basement area, a footer which supports the wall and a floor which spans the basement area and is spaced above the footer, said method comprising the steps of removing a portion of the floor marginally of a wall portion where there is water leakage, excavating the soil and any gravel beneath the removed portion of the floor to a depth sufficient to expose the footer, installing a drain conduit marginally of the inner surface of the footer, said drain conduit comprising an impervious trough and an openwork cover therefor, the edge of the drain conduit adjacent the footer being contiguous with the vertical plane of the inner surface of the footer and with the upper surface of the trough being no higher than the level of the upper surface of the footer, connecting the drain conduit to means for disposing leakage water from the basement, then filling said excavation with gravel having a size greater than the openings in said openwork cover, and pouring concrete over the gravel filled excavation to form a patch replacement for the removed portion of the floor.

2. A method as in claim 1 further comprising the step of sealing the contiguous edge of the drain conduit to the inner surface of the footer with a liquid impervious sealing material.

3. A method as in claim 2 further comprising the steps of pouring a concrete bed contiguous of the inner surface of the footer, and laying the drain conduit on said bed, in effecting installation of the drain conduit.

4. A method as in claim 1 wherein the foundation wall has a pre-existing crack which extends from the exterior surface thereof and opens on the interior surface thereof and provides a flow path for leakage ground water to leak from the outside of the wall to the interior thereof, and further comprising the step of channelizing the water flow through said crack to a point beneath the level of the floor by the attachment of strip means to the wall surface in overlying relation to the crack, said channelizing step being performed prior to filling the excavation with gravel.

5. A method as in claim 4 wherein the channelizing step comprises the steps of enlarging the opening of the crack onto the inner wall surface to a generally V-shaped configuration, adhering a strip of relatively thin moisture barrier, plastic film to the foundation wall, in overlying relation to the enlarged crack opening, and securing a fiberglass panel, having a width greater than the width of the film strip, to the foundation wall in overlying relation to the film strip.

6. A method as in claim 5 wherein the step of securing the fiberglass panel includes terminating the panel in spaced relation above the footer, and the step of securing the film strip includes terminating the attachment thereof to the foundation wall approximately at the lower end of the fiberglass panel, and further includes the step of disposing an extension of the film strip in overlying relation to the footer and the openwork cover of the drain conduit.

7. A method as in claim 1 wherein the foundation wall is formed of concrete blocks and further including the step of forming openings through the inner portions in the lower course of blocks, prior to filling the excavation with gravel, whereby water will flow from the inner chambers of the blocks onto the footer and then into the drain conduit.

8. A method as in claim 1 wherein the step of installing a drain conduit includes installing a drain conduit comprised of an impervious, upwardly open, plastic trough having a semicircular cross section and an openwork cover spanning said trough, said cover being formed of a wire screen with its lengthwise, marginal edge portions bent into engagement with the outer surface of the trough.

9. A method of waterproofing a basement comprising a foundation wall having portions defining the basement area, a footer which supports the wall and a floor which spans the basement area and is spaced above the footer, said method comprising the steps of removing a portion of the floor marginally of a wall portion where there is water leakage, forming an excavation lengthwise of the footer by removing the soil and any gravel beneath the removed portion of the floor to a depth sufficient to expose the footer, continuing removal of soil and any gravel to a depth beneath the lower surface of the footer when soil moisture indicates water leakage beneath the footer, installing, in said excavation, marginally of the vertical plane of the inner surface of the footer, a drain conduit comprising an impervious trough and an openwork cover therefor, said drain conduit being installed with the edge of the drain conduit adjacent the footer contiguous with the vertical plane of the inner surface of the footer and with the top surface of the trough disposed beneath the lower surface of the footer, connecting the drain conduit to means for disposing leakage water from the basement, then filling said excavation with gravel having a size greater than the openings in said openwork cover, and pouring concrete over the gravel filled excavation to form a patch replacement for the removed portion of the floor.

* * * * *